US006260627B1

(12) United States Patent
Rivas

(10) Patent No.: US 6,260,627 B1
(45) Date of Patent: Jul. 17, 2001

(54) SYSTEM AND METHOD FOR IMPROVING FLUID DYNAMICS OF FLUID PRODUCED FROM A WELL

(75) Inventor: Olegario Rivas, Bartlesville, OK (US)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/444,958

(22) Filed: Nov. 22, 1999

(51) Int. Cl.[7] ..... E21B 43/00
(52) U.S. Cl. ..... 166/369; 166/68
(58) Field of Search ..... 166/310, 369, 166/370, 312, 371, 68, 68.5

(56) References Cited

U.S. PATENT DOCUMENTS 4,580,634 * 4/1986 Cruise ..... 166/371
4,582,131 * 4/1986 Plummer et al. ..... 166/68
4,616,704 * 10/1986 Johnston ..... 166/242
4,749,034 * 6/1988 Vandevier et al. ..... 166/105
4,913,239 * 4/1990 Bayh, III ..... 166/385
5,367,214 * 11/1994 Turner, Jr. ..... 310/87
5,845,709 * 12/1998 Mack et al. ..... 166/302

* cited by examiner

*Primary Examiner*—Frank S. Tsay
(74) *Attorney, Agent, or Firm*—Fletcher, Yoder & Van Someren

(57) ABSTRACT

A system for pumping high gas-to-liquid ratio well fluids. The system includes a submersible pumping system having a submersible motor and a submersible pump driven by the motor. The system further includes deployment tubing, such as production tubing or coiled tubing, through which wellbore fluid is produced. A bypass is connected into the system to conduct a portion of the wellbore fluid intaken by the submersible pumping system to a position upstream of the pump intake. Because this recirculated fluid has a lower gas-to-liquid ratio and a lower viscosity, its reintroduction into the new wellbore fluid promotes efficiency of pumping and decreased wear on pumping system components.

20 Claims, 2 Drawing Sheets

SYSTEM AND METHOD FOR IMPROVING FLUID DYNAMICS OF FLUID PRODUCED FROM A WELL

FIELD OF THE INVENTION

This invention relates generally to a system and method for improving the fluid dynamics, specifically viscosity and gas-to-liquid ratio, of well fluids produced from reservoirs by a pumping system.

BACKGROUND OF THE INVENTION

Pumping systems, such as electric submersible pumping systems, are commonly used to transport fluids from a first location to a second remote location. An example of such a system is that used for transporting subterranean reservoir fluids from one location to another. A conventional application involves the pumping of fluids from a wellbore to a collection location at the surface of the earth.

Difficulties in transport can arise when the fluid to be transported is too viscous for adequate flow, and/or the fluid has an excessive gas-to-liquid ratio. Both of these types of problems can result in inadequate flow of the fluids through the pumping system and eventual system failure. The present invention solves such problems associated with pumping certain subterranean fluids.

Attempts have been made to lower the viscosity of high viscosity fluids by deploying heaters, in the form of heat trace tape and coil elements, in the wellbore. Such prior heater solutions, however, can have limited applications, require expensive secondary power cabling, and are prone to damage due to thermal cycling and corrosive environments. Oversized pumps and motors also have been used to pump such fluids. This solution, however, is less cost efficient, as the larger pumps and motors are substantially more expensive, require higher cost power cable and incur greater electric utility costs.

Other attempts have been made to inject well fluid with lower viscosity fluids or steam from a secondary and independent supply. The injection approach, while functional, requires an expensive supply source and tubing for directing the injected fluids. Such injection systems require regular maintenance and make the installation and support complex and expensive. Also, steam injection causes an increase in the gas-to-liquid ratio, thereby reducing the overall pumping system efficiency and potentially causing gas lock in the pump.

With respect to high gas-to-liquid ratio well fluids, problems include failure of the pumping system or at least a significant decrease in the overall efficiency of the pumping system. Prior solutions have included installation of commercially available rotary gas separators. While such gas separators are generally effective, they add cost to the system and have limited efficiency.

Other attempts have been made to locate the pumping equipment below the wellbore fluid inlet for the reservoir, e.g. wellbore casing perforations. While locating the equipment below the reservoir inlet has been effective for allowing a portion of the free gas to naturally vent to a location above the reservoir, a problem with this approach is that it can result in an inadequate flow rate past the motor, thereby causing excessive motor heating and resultant failures. Although excessive motor heating has been addressed in these applications through secondary solutions, such as flow diverting shrouds and recirculation systems, such secondary solutions are designed to cool the motor and are not intended to lower the gas-to-liquid ratio.

There is an increased need to provide enhanced and hybrid solutions to the problems of high viscosity and high gas-to-liquid ratios in wellbore fluids to facilitate production from otherwise marginal reservoirs.

SUMMARY OF THE INVENTION

The present invention features a system for pumping a wellbore fluid that has accumulated in a wellbore. The wellbore is of the type lined by a wellbore casing having at least one perforation to permit entry of the wellbore fluid. In particular, the system is amenable for pumping wellbore fluids having a high gas-to-liquid ratio.

The overall design includes a submersible pumping system having a submersible motor, a motor protector, a submersible pump driven by the submersible motor and a pump intake. The pumping system is located in the wellbore by a deployment system, e.g. production or coiled tubing, having a length that maintains the submersible pumping system above the at least one perforation. Furthermore, a bypass is connected into the system in a manner such that a portion of the wellbore fluid intaken by the submersible pumping system is directed to a position below the pump intake. This bypassing of a portion of the fluid both reduces the concentration of gas in the fluid intaken and lowers its viscosity.

According to another aspect of the invention, a system is provided for pumping a well fluid from a location in a wellbore. The system includes a submersible pumping system having a submersible motor, a submersible pump powered by the submersible motor and a pump intake having a fluid intake opening. The system further includes a bypass located to collect a portion of fluid from a location downstream of the fluid intake opening. The bypass is configured to direct the portion of fluid to a wellbore location upstream of the fluid intake opening. Additionally, the system includes a flow controller disposed to selectively control the amount of fluid flow through the bypass.

According to another aspect of the present invention, a method is provided for recovering a high gas-to-liquid fluid from a well. The method includes positioning a submersible pumping system in a well fluid, and pumping the well fluid to a desired location. The method further includes recirculating a portion of well fluid intaken by the submersible pumping system to a location upstream of the intake for the submersible pumping system. Also, the method includes selectively controlling the amount of well fluid that is recirculated.

According to yet another aspect of the present invention, a method is provided for recovering a high gas-to-liquid fluid from a wellbore. The wellbore is of the type lined by a wellbore casing having a perforation to permit entry of a reservoir fluid into the wellbore. The method includes positioning a submersible pumping system in the wellbore at a position above the perforation. Additionally, the method includes directing a wellbore fluid portion, intaken by the submersible pumping system, through a bypass. The wellbore fluid portion is discharged back into the wellbore at a position for intake by the submersible pumping system.

BRIEF DESCRIPTION OF THE DRAWINGS

The invention will hereafter be described with reference to the accompanying drawings, wherein like reference numerals denote like elements.

DETAILED DESCRIPTION OF THE PREFERRED EMBODIMENTS

Figure 1:
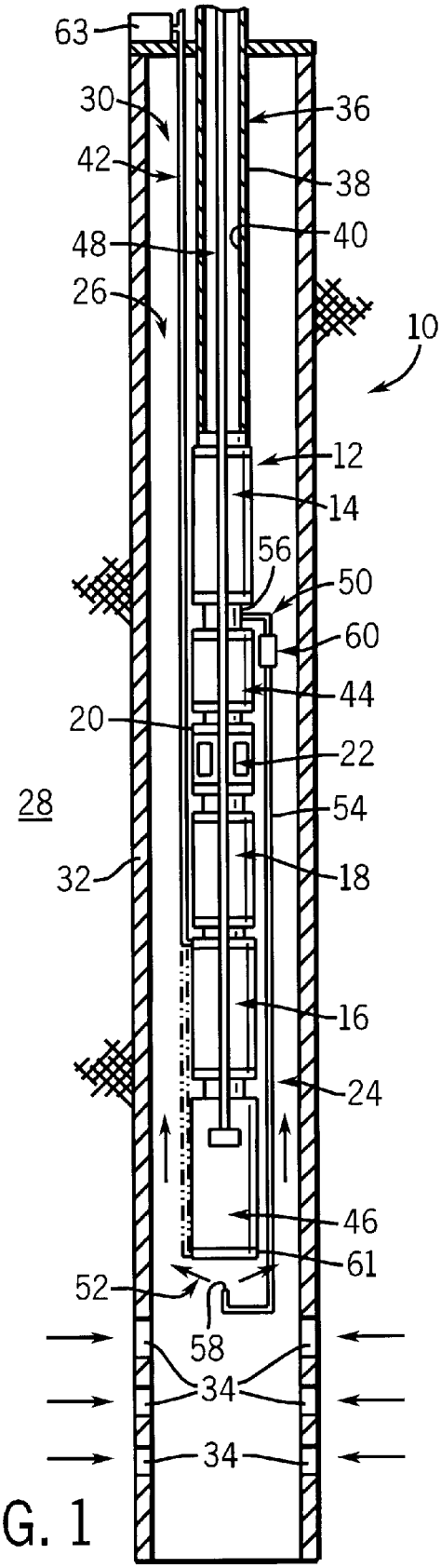
FIG. 1 is a front elevational view of an exemplary pumping system disposed within a wellbore, according to one embodiment of the present invention.

Referring generally to FIG. 1 an exemplary production system 10 is illustrated according to a preferred embodiment of the present invention. Production system 10 is designed for pumping fluids, such as well fluids, that have a high gas-to-liquid ratio and/or high viscosity. Production system 10 may utilize a variety of pumping systems for recovering fluids from a variety of reservoirs or other applications.

The exemplary embodiment of production system 10 illustrated in FIG. 1 includes a submersible pumping system 12, such as an electric submersible pumping system. Pumping system 12 may comprise a variety of components depending on the particular application or environment in which it is used. Typically, pumping system 12 includes at least a submersible production pump 14, e.g. a centrifugal pump, a submersible motor 16, a motor protector 18 and a pump intake 20 having at least one intake opening 22 and preferably a plurality of intake openings 22. Submersible pump 14 draws a wellbore fluid 24 into submersible pumping system 12 through intake openings 22.

In the illustrated example, pumping system 12 is designed for deployment in a well 26 within a geological formation 28 containing the wellbore fluid 24, e.g., petroleum. In a typical application, a wellbore 30 is drilled and lined with a wellbore casing 32. Wellbore casing 32 includes an opening and typically a plurality of openings 34, commonly referred to as perforations. Wellbore fluid 24 flows from the geological formation 28 through openings 34 and into wellbore 30.

Submersible pumping system 12 is deployed in wellbore 30 by a deployment system 36 that may have a variety of forms and configurations. For example, the deployment system 36 may comprise deployment tubing 38, such as production tubing or coiled tubing. Deployment system 36 is coupled to submersible pump 14, such that submersible pump 14 may discharge wellbore fluid 24 into a hollow interior 40 of deployment tubing 38. Preferably, deployment system 36 has a length that maintains pumping system 12 above openings 34 to ensure a flow of fluid past submersible motor 16 as well fluid is drawn to pump intake 20.

Power is provided to submersible motor 16 by a power cable 42. Power cable 42 typically is a multiconductor cable able to provide three-phase power to submersible motor 16. Motor 16 powers pump 14 to move the wellbore fluid 24 to a desired location, such as the surface of the earth.

It should be noted that a variety of components can be added or interchanged with the submersible pumping system components described. For example, a booster and mixing pump 44 may be connected into system 12. As illustrated, booster pump 44 is connected intermediate submersible production pump 14 and pump intake 20 to aid in the pumping of wellbore fluid and the separation of gas from the wellbore fluid. The fluids undergo a natural separation of gas and liquid just before entering the booster pump.

Alternatively, the booster pump 44 may be interchanged with or placed in sequence with a gas separator and/or an advanced gas handler system to further facilitate separation of gaseous components from liquid components in the wellbore fluid 24. When a booster pump is utilized, the pump is preferably of high or at least equal flow rate compared to the submersible production pump 14.

Another example of a submersible pumping system component that may be added is a downhole heater 46. Typically, heater 46 is connected into pumping system 12 beneath submersible motor 16. Energy is supplied to downhole heater 46 by either power cable 42 or an additional heater cable 48. Heater 46 can be used to lower the viscosity of wellbore fluid 24 before being drawn into pump intake 20.

Production system 10 further includes a bypass assembly 50 for recirculating a portion 52 of the wellbore fluid 24 intaken through pump intake 20. Bypass assembly 50 may include, for example, a tube 54 connected into production system 10 at a location downstream of pump intake 20 to divert portion 52 of the wellbore fluid to a location upstream of pump intake 20 within wellbore 30. In the example illustrated, bypass assembly 50 includes an intake 56 coupled in fluid communication with submersible pumping system 12 intermediate production pump 14 and pump intake 20. Specifically, intake 56 is disposed between submersible production pump 14 and booster pump 44. As the wellbore fluid is discharged from booster pump 44, portion 52 is diverted through intake 56 and routed through tube 54 until it is discharged through a discharge end 58 of bypass assembly 50. Typically, discharge end 58 is disposed at a location lower than or beneath submersible motor 16.

Bypass assembly 50 also includes a controller 60 that cooperates with tube 54 to control the amount of fluid flow therethrough. One exemplary embodiment of controller 60 is a valve that may be set to permit a desired flow rate through bypass tube 54. A valve 60 may be an electrically or pneumatically actuated valve such that the flow rate through the bypass can be controlled from a remote location. Appropriate signals can be provided to valve 60 via a conductor or pneumatic tube extending to the earth's surface. Such conductor or pneumatic control tube can be incorporated into power cable 42, as known to those of ordinary skill in the art. Alternatively, valve 60 can be controlled according to the output of a sensor 61 disposed in wellbore 30 to sense certain parameters, e.g. gas-to-liquid ratio, of the wellbore fluid. The signal typically is output to a control system 63 at the earth's surface, which, in turn, selectively adjusts controller 60 to permit a desired flow rate.

Figure 2:
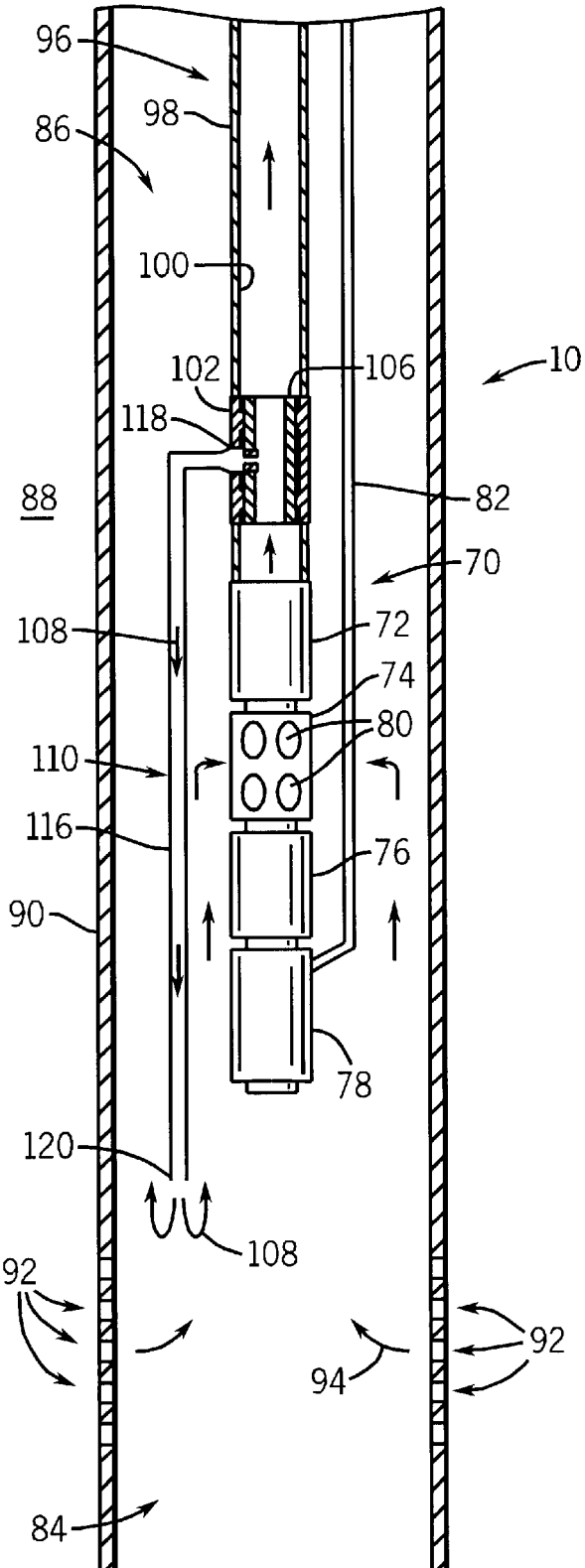
FIG. 2 is an alternate embodiment of the system illustrated in FIG. 1.

Referring generally to FIG. 2, an alternate embodiment of production system 10 is illustrated. In this embodiment, an exemplary submersible pumping system 70 includes a submersible production pump 72, a pump intake 74, a motor protector 76 and a submersible motor 78 for driving submersible pump 72. Pump intake 74 includes at least one and preferably a plurality of intake openings 80. Power is provided to submersible motor 78 by an appropriate power cable 82.

Submersible pumping system 70 is deployed for recovering fluids from a well 84, and typically is disposed within a wellbore 86 drilled within a geological formation 88. Wellbore 86 is lined by wellbore casing 90 having at least one and preferably a plurality of openings 92, commonly referred to as perforations. Perforations 92 permit a well fluid 94 to flow into wellbore 86 for intake by submersible pumping system 70 through pump intake 74.

Submersible pumping system 70 is deployed within wellbore 86 by a deployment system 96 including a deployment tubing 98 having a hollow interior 100 through which well fluids are pumped to a desired location. Exemplary deployment tubing 98 includes production tubing or coiled tubing. Deployment system 96 is connected to submersible pumping system 70 to receive fluid discharged by submersible pump 72.

Figure 3:
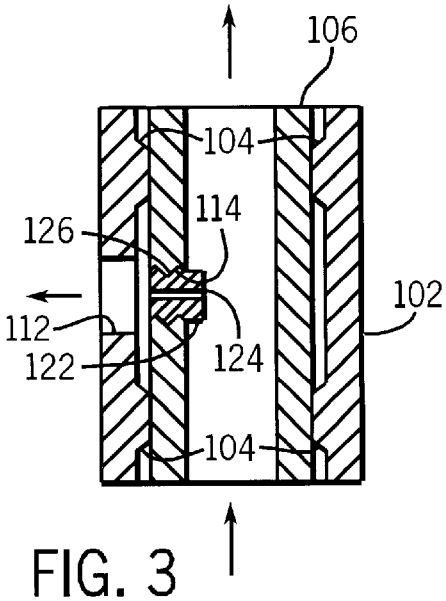
FIG. 3 is an enlarged view of the flow control system illustrated in FIG. 2.

As illustrated in FIGS. 2 and 3, deployment system 96 further includes a housing 102 preferably disposed at or slightly above submersible pumping system 70. Housing 102 includes a landing profile 104 for receiving a sleeve 106. Sleeve 106 is sized such that it may be moved through interior 100 of tubing 98 to a secure position at landing profile 104, as known to those of ordinary skill in the art. Preferably, sleeve 106 is designed for deployment to landing profile 104 and retrieval therefrom by a wireline.

In this particular embodiment, housing 102 and sleeve 106 are designed to permit a portion 108 of the wellbore fluid intaken through pump intake 74 to be diverted to a bypass system 110. Specifically, housing 102 includes a port 112, and sleeve 106 includes an opening 114 through which well fluid portion 108 exits deployment tubing 98 for recirculation via bypass system 110.

Bypass system 110 may be in the form of a tube 116 having an intake end 118 that is coupled to housing 102 at port 112. Tube 116 also includes a discharge end 120 located upstream of pump intake 74 within wellbore 86. Preferably, discharge end is located proximate or below the bottom of submersible pumping system 70 when deployed in wellbore 86.

As submersible pumping system 70 produces wellbore fluid to tubing 98, portion 108 is diverted through sleeve 106, housing 102 and bypass 110 to a desired discharge location within wellbore 86 such that it may once again be intaken, i.e. recirculated, by pump intake 74. By the time fluid portion 108 is diverted at housing 102, the viscosity has been lowered, and a substantial amount of gas within the wellbore fluid has been released. This less viscous, lower gas-to-liquid ratio fluid is mixed with new wellbore fluid 94 and reintroduced to submersible pumping system 70. The recirculation of fluid effectively lowers the overall viscosity and gas-to-liquid ratio to promote more efficient pumping and to reduce wear and/or failure of pumping system components. As described above, a gas separator or advanced gas handling system can be incorporated into submersible pumping system 70 to further separate gas from the well fluid by the time it reaches intake end 118 of bypass 110. Additionally, heaters and other components can be added to submersible pumping system 72 to alter certain characteristics of the well fluid.

The amount of fluid passing through bypass 110 can be selectively controlled by an appropriate controller, as discussed above. An alternate controller 122 is best illustrated in FIG. 3. Alternate controller 122 comprises an orifice having a calibrated opening 124 designed to permit a predetermined outflow of fluid along bypass 110. Alternate controller 122 preferably is interchangeable with other orifices having differently sized calibrated openings 124. For example, alternate controller 122 may have a threaded exterior 126 designed for threaded engagement with opening 114 of sleeve 106. Thus, the amount of portion 108 flowing through bypass 110 can be changed by retrieving sleeve 106 (via wireline, for example) interchanging the alternate controller with another orifice, and redeploying sleeve 106 to landing profile 104. The configuration of sleeve 106 and landing profile 104 guide sleeve 106 into an appropriate position to align orifice 124 and opening 114 with port 112 to permit outflow of portion 108.

It will be understood that the foregoing description is of preferred exemplary embodiments of this invention, and that the invention is not limited to the specific forms shown. For example, the submersible pumping system may have a variety of additional or interchangeable components; the bypass may have a variety of constructions and may direct the portion of wellbore fluid to variety of desired locations; the controller may have a variety of configurations including configurations that permit automatic adjustment from a remote location, e.g. electrically or pneumatically adjustable valves; and the system may be utilized in transporting a variety of fluids between a variety of locations. These and other modifications may be made in the design and arrangement of the elements without departing from the scope of the invention as expressed in the appended claims.

What is claimed is:

1. A system for pumping a wellbore fluid accumulated in a wellbore lined by a wellbore casing having a perforation to permit entry of the wellbore fluid, comprising:

a submersible pumping system having:
- a submersible motor;
- a motor protector;
- a pump intake;
- a submersible pump driven by the submersible motor;
- a deployment system having a length that maintains the submersible pumping system above the perforation;
- a bypass arranged to conduct a portion of wellbore fluid intaken by the submersible pumping system to a position below the pump intake; and
- a calibrated orifice located to control fluid flow through the bypass.

2. The system as recited in claim 1, further comprising a sleeve in which the calibrated orifice is mounted, the sleeve being sized to slide through the tubing to the location.

3. The system as recited in claim 2, wherein the deployment system includes a housing having a part to which the bypass is coupled and an internal landing profile to receive and hold the sleeve such that the calibrated orifice is generally aligned with the port.

4. The system as recited in claim 3, wherein the sleeve is wireline retrievable.

5. The system as recited in claim 4, wherein the calibrated orifice may be removed and replaced with a different calibrated orifice.

6. A system for pumping a wellbore fluid accumulated in a wellbore lined by a wellbore casing having a perforation to permit entry of the wellbore fluid comprising:

a submersible pumping system having:
- a submersible motor;
- a motor protector;
- a pump intake;
- a submersible pump driven by the submersible motor;
- a deployment system having a length that maintains the submersible pumping system above the perforation;
- a bypass arranged to conduct a portion of wellbore fluid intaken by the submersible pumping system to a position below the pump intake, wherein the bypass includes a flow control valve.

7. A system for pumping a well fluid from a location in a wellbore, comprising:

a submersible pumping system having:
- a submersible motor;
- a submersible pump powered by the submersible motor;
- a pump intake having a fluid intake opening;

a bypass located to collect a portion of fluid from a location downstream of the fluid intake opening, the bypass being routed to direct the portion of fluid to a wellbore location upstream of the fluid intake opening; and a flow controller disposed to selectively control the amount of fluid flow through the bypass, wherein the flow controller comprises a variable valve.

8. The system as recited in claim 7, wherein the variable valve may be adjusted from a remote location to control the flow rate of fluid through the bypass.

9. A system for pumping a well fluid from a location in a wellbore, comprising:

a submersible pumping system having:

a submersible motor;

a submersible pump powered by the submersible motor;

a pump intake having a fluid intake opening;

a bypass located to collect a portion of fluid from a location downstream of the fluid intake opening, the bypass being routed to direct the portion of fluid to a wellbore location upstream of the fluid intake opening; and a flow controller disposed to selectively control the amount of fluid flow through the bypass, wherein the flow controller comprises a variable orifice.

10. A system for pumping a well fluid from a location in a wellbore, comprising:

a submersible pumping system having:

a submersible motor;

a submersible pump powered by the submersible motor;

a pump intake having a fluid intake opening;

a bypass located to collect a portion of fluid from a location downstream of the fluid intake opening, the bypass being routed to direct the portion of fluid to a wellbore location upstream of the fluid intake opening; and a flow controller disposed to selectively control the amount of fluid flow through the bypass, wherein the bypass includes an inlet coupled in fluid communication with the submersible pumping system at a location intermediate the submersible pump and the pump intake.

11. A system for pumping a well fluid from a location in a wellbore, comprising:

a submersible pumping system having:

a submersible motor;

a submersible pump powered by the submersible motor;

a pump intake having a fluid intake opening;

a bypass located to collect a portion of fluid from a location downstream of the fluid intake opening the bypass being routed to direct the portion of fluid to a wellbore location upstream of the fluid intake opening; and a flow controller disposed to selectively control the amount of fluid flow through the bypass; and a deployment system to deploy the submersible pumping system in the wellbore, the deployment system including a tubing through which fluid may be pumped.

12. The system as recited in claim 11, wherein the deployment system includes a housing having a port in fluid communication with the bypass and a landing profile.

13. The system as recited in claim 12, wherein the flow controller includes a sleeve having an interchangeable orifice, the sleeve being sized for receipt in the landing profile such that the interchangeable orifice is generally aligned with the port.

14. A method of recovering a high gas-to-liquid fluid from a well comprising:

positioning a submersible pumping system in a well fluid;

pumping the well fluid to a desired location;

recirculating a portion of well fluid intaken by the submersible pumping system to a location upstream of a submersible pumping system intake; and selectively controlling the amount of well fluid recirculated by placing a valve in series with a bypass and directing the portion of well fluid through the valve and the bypass.

15. A method of recovering a high gas-to-liquid fluid from a well, comprising:

positioning a submersible pumping system in a well fluid;

pumping the well fluid to a desired location;

recirculating a portion of well fluid intaken by the submersible pumping system to a location upstream of a submersible pumping system intake; and selectively controlling the amount of well fluid recirculated by placing an orifice of precalculated size in series with a bypass and directing the portion of well fluid through the orifice and the bypass.

16. A method of recovering a high gas-to-liquid fluid from a well comprising:

positioning a submersible pumping system in a well fluid, wherein positioning includes positioning an electric submersible pumping system within a wellbore lined by a wellbore casing having a perforation, the electric submersible pumping system being positioned above the perforation pumping the well fluid to a desired location;

recirculating a portion of well fluid intaken by the submersible pumping system to a location upstream of a submersible pumping system intake; and selectively controlling the amount of well fluid recirculated.

17. A method of recovering a high gas-to-liquid fluid from a well comprising:

positioning a submersible pumping system in a well fluid;

pumping the well fluid to a desired location;

recirculating a portion of well fluid intaken by the submersible pumping system to a location upstream of a submersible pumping system intake, wherein recirculating includes directing the portion of well fluid to a location beneath the submersible pumping system; and selectively controlling the amount of well fluid recirculated.

18. The method as recited in claim 16, wherein recirculating includes directing the portion of well fluid to a location beneath the submersible pumping system.

19. A method of recovering a high gas-to-liquid fluid from a wellbore lined by a wellbore casing having a perforation to permit entry of a reservoir fluid into the wellbore, comprising:

positioning a submersible pumping system in the wellbore at a position above the perforation;

directing a wellbore fluid portion intaken by the submersible pumping system through a bypass and discharging the welibore fluid portion back into the wellbore at a position for intake by the submersible pumping system;

pumping a wellbore fluid through a deployment system having a deployment tubing;

connecting the bypass in fluid communication with the deployment system; and combining a housing having a landing profile with the deployment tubing, coupling the bypass with the housing, and placing a sleeve with a calibrated orifice at the landing profile to control fluid flow.

20. The method as recited in claim 19, further comprising selectively controlling from a remote location the amount of the wellbore fluid portion that is recirculated.

* * * * *